US008449134B2

(12) United States Patent
Lin

(10) Patent No.: US 8,449,134 B2
(45) Date of Patent: May 28, 2013

(54) SOLAR RAZOR

(76) Inventor: Hsin-Chen Lin, Kaohsiung (TW)

( * ) Notice: Subject to any disclaimer, the term of this patent is extended or adjusted under 35 U.S.C. 154(b) by 0 days.

(21) Appl. No.: 13/445,886

(22) Filed: Apr. 12, 2012

(65) Prior Publication Data

US 2012/0268923 A1 Oct. 25, 2012

(30) Foreign Application Priority Data

Apr. 19, 2011 (TW) ..... 100206841

(51) Int. Cl.
*B26B 19/46* (2006.01)

(52) U.S. Cl.
USPC ..... 362/115; 362/109; 362/183

(58) Field of Classification Search
USPC ..... 362/109, 115, 119, 120, 183; 30/34.05, 30/43.4–43.6
See application file for complete search history.

(56) References Cited

U.S. PATENT DOCUMENTS 6,986,206 B2 * 1/2006 McCambridge et al. ..... 30/34.1
7,036,952 B2 * 5/2006 Zirk et al. ..... 362/119
2003/0131480 A1 * 7/2003 Leung et al. ..... 30/210

* cited by examiner

*Primary Examiner* — Thomas Sember

(57) ABSTRACT

A solar razor is provided with a housing; at least one shaving assembly rotatably mounted on the housing; a solar cell mounted on an outer surface of the housing for converting light directly into electricity; a rechargeable battery disposed in the housing and connected to the solar cell for storing electricity from the solar cell, the rechargeable battery being electrically connected to the shaving assembly; and a switch mounted on the outer surface of the housing and electrically connected to the rechargeable battery, the switch being manually movable between first and second positions. The rechargeable battery disconnects from the at least one shaving assembly when the switch is in the first position. The rechargeable battery connects to the at least one shaving assembly when the switch is in the second position.

3 Claims, 2 Drawing Sheets

SOLAR RAZOR

BACKGROUND OF THE INVENTION

1. Field of the Invention

The invention relates to razors and more particularly to a solar-charged razor.

2. Description of Related Art

Solar energy, radiant light and heat from the sun, has been harnessed by humans since ancient times using a range of ever-evolving technologies. Solar energy technologies include solar heating, solar photovoltaics, solar thermal electricity and solar architecture, which can make considerable contributions to solving some of the most urgent problems the world now faces.

Conventional electric razors are powered by a small DC motor which is either powered by rechargeable batteries or mains electricity. The rechargeable battery is nickel cadmium, nickel metal hydride or lithium-ion battery. However, charging a discharged battery is always bothersome when a user is out of home. Thus, the need for improvement still exists.

SUMMARY OF THE INVENTION

It is therefore one object of the invention to provide a solar razor comprising a housing; at least one shaving assembly rotatably mounted on the housing; a solar cell mounted on an outer surface of the housing for converting light directly into electricity; a rechargeable battery disposed in the housing and connected to the solar cell for storing electricity from the solar cell, the rechargeable battery being electrically connected to the shaving assembly; and a switch mounted on the outer surface of the housing and electrically connected to the rechargeable battery, the switch being manually movable between first and second positions, wherein the rechargeable battery disconnects from the at least one shaving assembly when the switch is in the first position, and the rechargeable battery connects to the at least one shaving assembly when the switch is in the second position.

The above and other objects, features and advantages of the invention will become apparent from the following detailed description taken with the accompanying drawings.

DETAILED DESCRIPTION OF THE INVENTION

Figure 1:
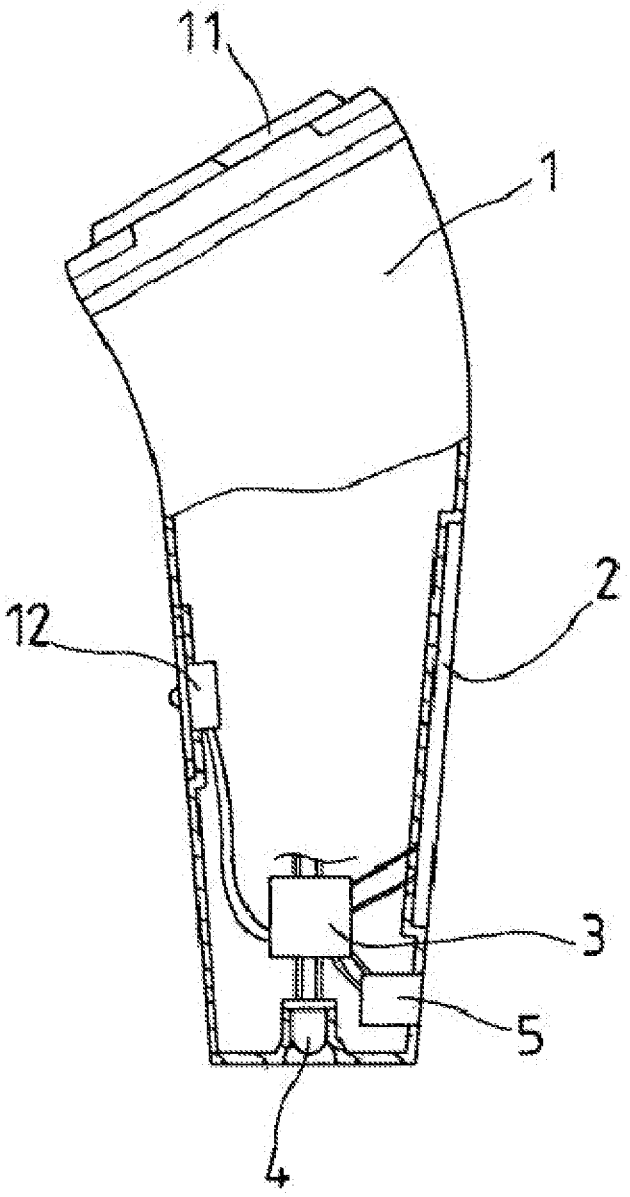
FIG. 1 is a longitudinal sectional view of a solar razor according to the invention.
Figure 2:
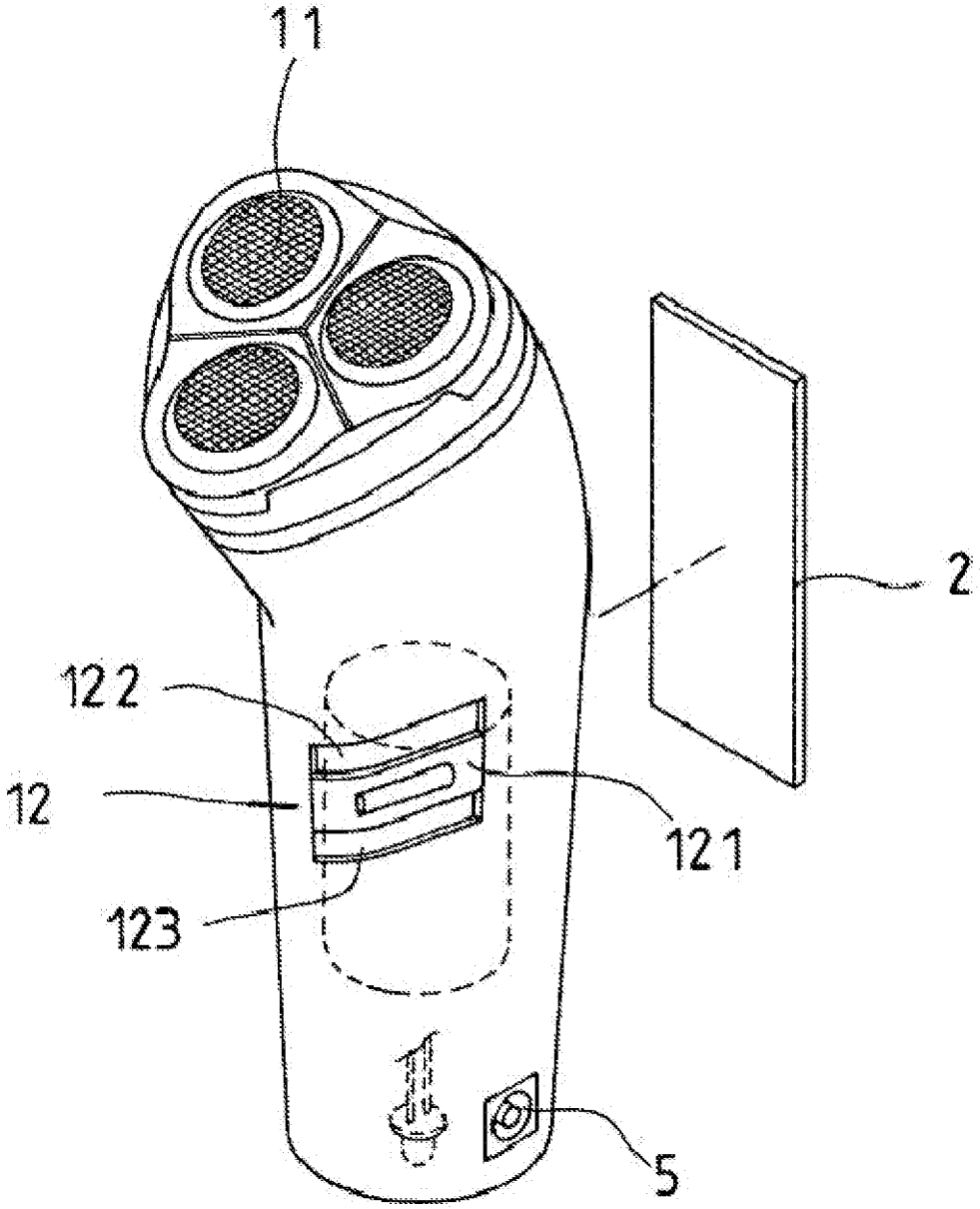
FIG. 2 is an exploded perspective view of the solar razor.

Referring to FIGS. 1 and 2, a solar razor in accordance with the invention comprises the following components as discussed in detail below.

A housing 1 is substantially cylindrical. Three shaving assemblies 11 are mounted are an inclined top of the housing 1 and arranged as a triangle. A solar cell 2 is mounted on an outer surface of the housing 1 and can convert the energy of light (e.g., sunlight) directly into electricity by the photovoltaic effect. A lamp (e.g., light-emitting diode (LED)) 4 is mounted on a bottom of the housing 1.

A rechargeable battery 3 is provided in the housing 1 and is connected to the solar cell 2 for storing electricity from the solar cell 2. The battery 3 is also electrically connected to both the lamp 4 and the shaving assemblies 11. A switch 12 is mounted on the outer surface of the housing 1 opposite the solar cell 1 and electrically connected to the battery 3. The switch 12 is manually movable among first, second, and third positions 121, 122, and 123.

The battery 3 disconnects from the shaving assemblies 11 when the switch 2 is in the first position (i.e., off or default position). The battery 3 connects to the shaving assemblies 11 when the switch 2 is in the second position (i.e., on or operating position). The shaving assemblies 11 rotate in the second position. The battery 3 connects to the lamp 4 when the switch 2 is in the third position. The lamp 4 is thus lit to provide illumination to a user in a dark environment.

A jack 5 is mounted proximate to a bottom of the housing 1. A user may connect a plug of an alternating current (AC) to direct current (DC) converter (not shown) to the jack 5 and plug a plug of the converter into a socket so that household electricity can be supplied to the battery 3 for storage via the converter. This function is for the purpose of providing an alternative means of storing electricity in the battery 3 when light (e.g., sunlight) is not available.

While the invention has been described in terms of preferred embodiments, those skilled in the art will recognize that the invention can be practiced with modifications within the spirit and scope of the appended claims.

What is claimed is:

1. A solar razor comprising:

a housing;

at least one shaving assembly rotatably mounted on the housing;

a solar cell mounted on an outer surface of the housing for converting light directly into electricity;

a rechargeable battery disposed in the housing and connected to the solar cell for storing electricity from the solar cell, the rechargeable battery being electrically connected to the shaving assembly;

a switch mounted on the outer surface of the housing and electrically connected to the rechargeable battery, the switch being manually movable between first and second positions, and a lamp mounted on the outer surface of the housing and configured to provide sufficient illumination for the user when in a darkened environment, wherein the rechargeable battery disconnects from the at least one shaving assembly when the switch is in the first position, the rechargeable battery connects to the at least one shaving assembly when the switch is in the second position, and the switch is further manually movable to a third position, the rechargeable battery connecting to the lamp when the switch is in the third position to provide illumination for the user when in the darkened environment.

2. The solar razor of claim 1, wherein the lamp is a light-emitting diode (LED).

3. The solar razor of claim 1, further comprising a jack mounted on the outer surface of the housing.

* * * * *